United States Patent [19]

Buda

[11] 4,426,170

[45] Jan. 17, 1984

[54] AUTOMATIC PAPER ROLLER RELEASE MECHANISM FOR TELETYPE AND ELECTRIC TYPEWRITERS

[76] Inventor: John J. Buda, 885 De Frame, Golden, Colo. 80401

[21] Appl. No.: 378,513

[22] Filed: May 17, 1982

Related U.S. Application Data

[63] Continuation-in-part of Ser. No. 147,352, May 7, 1980.

[51] Int. Cl.[3] ..... B41J 13/036

[52] U.S. Cl. ..... 400/636.1; 400/637

[58] Field of Search ..... 400/314.1, 636.1, 636.2, 400/636, 636.3, 637, 637.1, 637.2, 637.3, 637.4, 637.5, 637.6, 639, 639.1, 639.2, 669, 668, 666, 673

[56] References Cited

U.S. PATENT DOCUMENTS

| | | | |
|---|---|---|---|
| 980,689 | 1/1911 | Smith | 400/636.1 |
| 1,106,929 | 8/1914 | Dennis | 400/637.4 X |
| 2,332,033 | 10/1943 | Welker | 400/639.1 X |
| 2,862,596 | 12/1958 | Metzner | 400/637.5 X |
| 2,885,053 | 5/1959 | Davidson | 400/314.1 X |
| 3,421,612 | 1/1969 | Pitt | 400/636 X |
| 3,677,452 | 7/1972 | Wallace | 400/637.1 X |
| 4,173,420 | 11/1979 | Okabe | 400/636.1 X |

FOREIGN PATENT DOCUMENTS 2534439 4/1976 Fed. Rep. of Germany ..... 400/636

*Primary Examiner*—Edgar S. Burr
*Assistant Examiner*—Charles A. Pearson
*Attorney, Agent, or Firm*—Horace B. Van Valkenburgh

[57] ABSTRACT

A lever for moving a shaft which, in turn, moves pressure rollers away from the platen, against which the paper is held by the pressure rollers, is movable between first and second positions. The lever is urged, as by a spring, toward the first position which corresponds to the paper engaging position of the rollers. When moved to the second position, the lever is engaged by releasable holding means which is resiliently urged toward the lever but is retracted by electromagnetic means. The latter is energized by current supplied through two switches in series, one of which is closed when the lever is moved to the second position, and the other of which is closed when the carriage of the teletypewriter or the typewriter is returned. The switch closed by the lever, when open, with the lever in the first position, prevents the electromagnetic means from being energized each time the carriage returns, after the lever has been released through the electromagnetic means and is moved by the spring back to the first position.

5 Claims, 5 Drawing Figures

AUTOMATIC PAPER ROLLER RELEASE MECHANISM FOR TELETYPE AND ELECTRIC TYPEWRITERS

This application is a continuation -in-part of my copending application Ser. No. 147,352, filed May 7, 1980.

This invention relates to feed roller release mechanisms of teletype and electric typewriters and more particularly to a device for holding a release lever in a position in which the feed rollers are released but automatically returning it to a position in which the feed rollers are engaged when normal operation of the teletype or typewriter is resumed.

BACKGROUND OF THE INVENTION

When operation of a teletype typewriter is discontinued for a period, the feed rollers which are normally resiliently urged toward the platen to cause the paper to be fed by friction around the platen as the platen turns, are released by a conventional lever. This moves the feed rollers away from the platen, so that a new supply of paper may be fed through when operation is resumed. However, when the operator feeds new paper between the feed rollers and the platen, particularly when multiple copy paper is ued, sufficient friction may be encountered so that the operator has a false impression that the feed rollers are engaging the paper and thus overlooks restoration of the release lever to its paper feed position. In addition, with the prior types of release lever, one operator may attempt to sabotage the machine of a second operator against whom the first operator has a grudge, as when the second operator leaves his or her machine for some reason. This is accomplished by surreptitiously pushing the release lever of a second operator's machine, so that the paper will no longer be fed and the machine will continue to type on a single line. Such sabotage is, of course, impossible with a sprocket feed, but this requires much more expensive paper.

Among the objects of this invention are to overcome this problem by the provision of a device for holding a release lever in a release position until the teletype is started again but then restore the release lever to the position in which the feed rollers will engage the paper sufficiently; to provide such a device which will prevent sabotage through surreptitious movement of the release lever; to provide such a device which is also useful on an electric typewriter; to provide such a device which will operate effectively and efficiently; and to provide such a device which is readily applied to a teletype or electric typewriter, is inexpensive to manufacture and is comparatively simple in design.

SUMMARY OF THE INVENTION

A device of this invention includes a release lever specially adapted to be shifted to a release position and held in that position until it is permitted to return to the feed roller engaging position. Such a release lever is engaged by a member resiliently urged against the release lever but which is automatically withdrawn, as by an electromagnet, when the teletype or typewriter is restarted. Such a member may be a button urged by a spring against a socket in the release lever and mounted on a pin surrounded by the spring and moved away from the socket by the electromagnet. The electromagnet is automatically energized when the teletype or typewriter is started in operation again, as by a switch closed by the carriage return or an extension thereof. To prevent loss of resiliency of such a spring, through frequent energization and deenergization of such an electromagnet each time the carriage returns, another switch is closed when the release lever is in a release position. This switch is in series with the switch closed by the carriage return, so that when the release lever is returned to its initial position, the release lever switch will be open and current will no longer be supplied to the electromagnet when the carriage return switch is closed. In the event of attempted sabotage, the release lever will return to its initial position on the next carriage return.

THE DRAWINGS

DESCRIPTION OF THE PREFERRED EMBODIMENT

Figure 1:
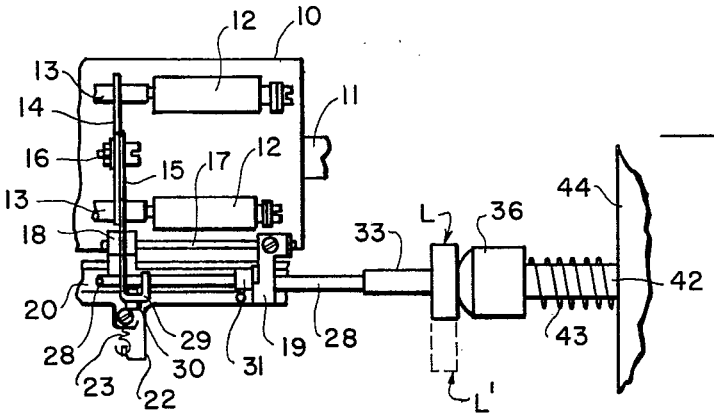
FIG. 1 is a fragmentary bottom plan view of a platen assembly and a release lever of this invention.
Figure 4:
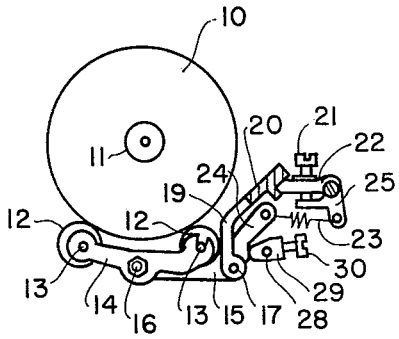
FIG. 4 is an end elevation of the platen assembly.

As illustrated in FIG. 1, a device of this invention is shown as embodied in a teletypewriter having a conventional platen 10 mounted on a shaft 11 and engaged by rollers 12 which press the paper against the platen so that the paper will be moved in synchronism with the platen. Rollers 12 are conventionally supported by rods 13 which, in turn, are mounted on brackets 14, as also shown in FIG. 4. One end of an angular arm 15 is pivotally connected to the center of bracket 14 by a bolt 16, while the center of arm 15 is mounted on a pivot pin 17 which extends longitudinally through a bracket 18 and a slot, into which, as in FIG. 1, arm 16 also extends. Pivot pin 17 is supported at one end by a bracket 19 and may extend longitudinally to the position of additional arms corresponding to arm 16 and additional brackets corresponding to bracket 14, it being understood that two additional rollers similar to rollers 12 may be in longitudinal alignment with the two shown. Brackets 18 and 19, as well as additional brackets adjacent the additional rollers corresponding to rollers 12, extend from or are mounted on the frame of the teletype, a portion 20 of which is shown. A bracket 22 is also mounted on frame 20 and carries a spring 23, while the end 24 of arm 15, opposite bolt 16, is pulled by spring 23 in a direction to urge rollers 12 against the platen 10. Spring 23 extends from a pivoted mounting arm 25 whose position is adjusted by a screw 26.

Rollers 12 are released through a shaft 28, on which is mounted a bifurcated cam 29 by a set screw 30. One side of cam 29 engages the underside of arm 15 above pin 17, as in FIG. 4, to move arm 15 in a counter clockwise direction as viewed in FIG. 4, thereby pulling rollers 12 away from platen 10, against the tension of spring 23. A collar 31 on shaft 28 at bracket 19 assists in maintaining the longitudinal position of the shaft. Normally, shaft 28 is provided with a manually operable handle (not shown), as by bending the shaft to form a lateral and then a longitudinal offset. When shaft 28 is moved in a clockwise direction, as viewed in FIG. 4, cam 29 will pivot also in a clockwise direction and shift lever 15 so that bolt 16 will move downwardly. As cam 29 pivots, it will become perpendicular to end 24 of the lever 16 and will tend to stay in that position unless changed by movement of shaft 28 through its normal handle.

At the close of an operational day, as in the evening, it is customary for an operator to shift rollers 12 to a position away from platen 10, so that a new supply of paper may be inserted readily. As a result, when the teletype is started on the next shift, such as the next morning, the operator often merely inserts new paper and starts the machine by closing the starting switch, but overlooks moving the rollers back toward the platen. Thus, the machine may operate, sometimes for a considerable period of time, without the paper moving and thereby merely type a large number of lines on the same line of the paper. This may go on for some time until the operator, or perhaps someone else, notices that the paper is not feeding through the machine.

Figure 2:
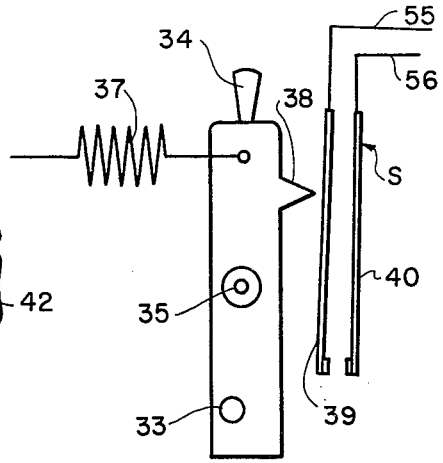
FIG. 2 is an end elevation of the release lever of FIG. 1, showing contacts adapted to be closed by the release lever.

In accordance with this invention, a release lever L is attached to an enlartement 33 of shaft 28 and is maintained in a position, after being shifted, in which the rollers 12 are spaced away from the platen 10, i.e. such as the full position of FIG. 1, but will be automatically returned to a position in which the cam 29 will be returned to the position of FIG. 4, such as the dotted lever position L' of FIG. 1. The enlargement 33 of shaft 28 may be connected to lever L adjacent its lower end, as in FIGS. 2 and 3, while lever L may be provided with a handle 34 at the top, for shifting to the full position of FIG. 1 and a socket 35, conveniently centrally located on one side, which is engageable by a button 36, as in FIG. 1, when the handle is shifted to the full position of FIG. 1. A spring 37 of FIG. 2 may be connected to the upper end of lever L to pull the lever back to the dotted position of FIG. 1 when button 36 is withdrawn from socket 35. A projection 38 of FIG. 2, on the opposite side of lever L from spring 37, engages a contact 39 of a switch S to close it against a contact 40 when the lever is moved to the full position of FIG. 1, it being noted that the position of lever L in FIG. 2 corresponds to the dotted position L' of FIG. 1. Button 36 may be mounted on the outer end of a stem 42 surrounded by a coil spring 43 and extending within a housing 44 of an electromagnet E to an armature 45 within the housing. Coil spring 43 extends between the button 36 and housing 44, in order to urge the button into socket 35, but the button is withdrawn when a coil 46 of the electromagnet within the housing is energized to pull stem 42 and button 36 back to the position of FIG. 3. As will be evident, when coil 46 is de-energized, spring 42 will move button 36 and stem 42 to the more extended position of FIG. 1, in which button 36 will snap into socket 35 when lever L is moved from the dotted position of FIG. 1, which corresponds to the positions of FIGS. 2 and 3, to the full position of FIG. 1. At the same time, projection 38 will close contacts 39 and 40 of switch S.

Figure 3:
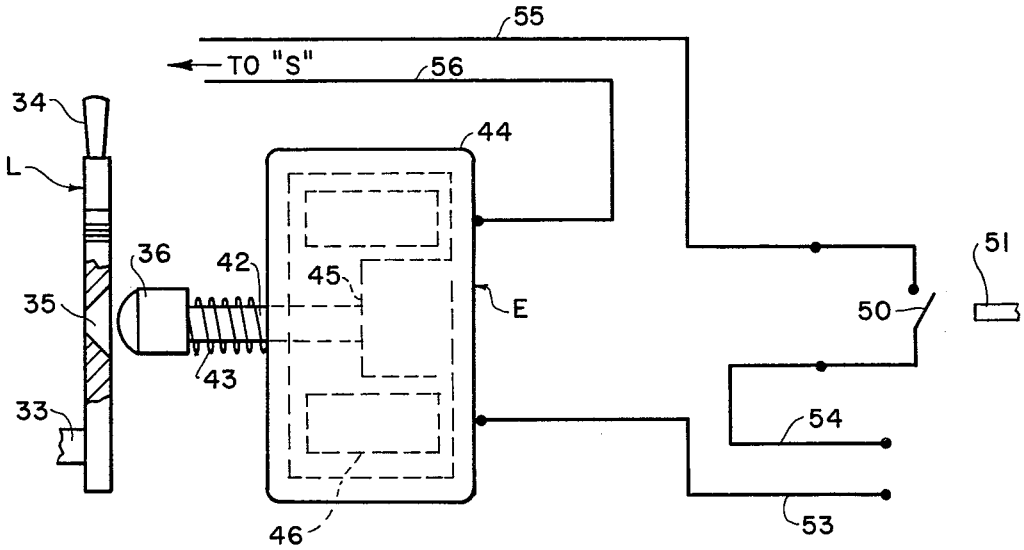
FIG. 3 is a front elevation of the release lever, showing also an armature controlled knob and a circuit associated with the armature and the switch of FIG. 2.

In further accordance with this invention, a switch 50 of FIG. 3 is in series with contacts 39 and 40 and is also closed by an extension 51 of the carriage return, when the conventional switch is closed to turn on the machine, so that switch 50 will be closed when the machine begins operation again. This will cause coil 46 to be energized and button 36 to be withdrawn from socket 35, thereby permitting spring 37 to pull lever L to the dotted position of FIG. 1 and move rollers 12 again against the paper around platen 10. The circuit may include power leads 53 and 54, the former extending to one terminal of coil 46 and the latter to one terminal of switch 50. The opposite terminal of switch 50 is connected by a wire 55 with contact 39, while contact 40 is connected with the opposite terminal of coil 46 by a wire 56. As will be evident, although switch S is closed when lever L is moved to the full line position of FIG. 1 and the rollers 12 are withdrawn, coil 46 of electromagnet E will not be energized since the machine is off and switch 50 will be open. It is noted that switch 50 is shown in open position in FIG. 3 for clarity of illustration, and it will be recognized that armature 45 will not be withdrawn, as shown, until switch 50 has been closed. In any event, the arrangement is such that no current will be supplied to electromagnet E when lever L is in the dotted position of FIG. 1. It will also be evident that the rollers 12 will be automatically moved against the paper around the platen when the on switch for the machine is closed and switch 50 is closed on the first carriage movement. Also, when lever L is moved back to the position of FIG. 2, even though switch 50 is closed by each return of the carriage, electromagnet E will not be energized, since switch S will be open. Thus, spring 43 will not lose its resiliency due to energization of electromagnet E each time switch 50 is closed by extension 51 of the carriage return.

Figure 5:
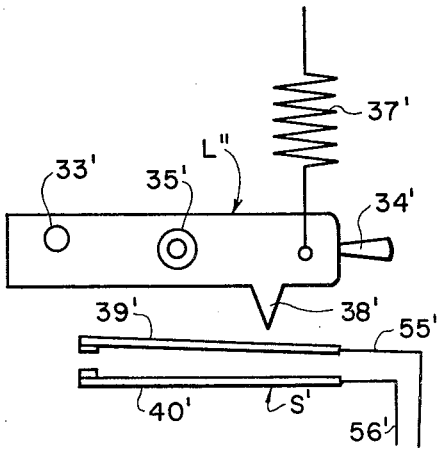
FIG. 5 is a side elevation of a similar release lever for use with an electric typewriter platen and associated contacts.

In FIG. 5 is shown an adaptation of the parts of FIGS. 1–4 to a typewriter, including a release lever L" which is similar to lever L and may be moved by a handle 34' to pivot a shaft, to an enlargement 33' of which the lever is attached. This shaft, corresponding to shaft 28, is adapted to release the conventional platen rollers and release the paper, while a button corresponding to button 36 will engage socket 35'. A projection 38' on lever L" will also close a switch S' by moving contact 39' into engagement with contact 40', as before. A spring 37' pulls lever L" back to its initial position when socket 35' is released by the button corresponding to button 36. The remaining parts of the adaptation to a typewriter may be similar to the parts shown in FIGS. 1–3, including an electromagnet corresponding to electromagnet E and adapted to move the button away from socket 35' and a switch corresponding to switch 50 and closed by an extension carriage return corresponding to extension 51 of FIG. 3, so that the electromagnet will release the lever when the typewriter is started in operation. The electrical circuit, including wires 55' and 56' of FIG. 5, which correspond to wires 55 and 56 of FIGS. 2 and 3, may be similar to the circuit previously described. As will be evident, the advantages of the typewriter application correspond to those of the teletypewriter adaptation.

The apparatus of this invention may be adapted for use in conjunction with a sequentially operated teletype universal switch or SOTUS, also known as a "stunt box," by utilizing one of the switches of the SOTUS to perform the function of switch 50.

Although a preferred embodiment of this invention has been illustrated and described, it will be evident that other embodiments may exist and that various changes may be made therein without departing from the spirit and scope of this invention.

What is claimed is:

1. In a feed roller release mechanism, for a device having a platen mounted on a carriage, a series of pressure rollers normally urged toward said platen for urging paper or the like against said platen, means for moving said pressure rollers away from said platen and means including shaft means for shifting said moving means, the improvement comprising:

a lever movable between first and second positions for moving said shaft means between positions corresponding to the positions of said rollers adjacent and urged toward said platen and said rollers being spaced from said platen;

means urging said lever toward said first position corresponding to the position of said rollers when urged toward said platen;

means for releasably holding said lever in said second position corresponding to said rollers being spaced from said platen;

elctromagnetic means for causing said holding means to be released from said lever;

means for activating said electromagnetic means with said lever in said second position and movement of said carriage to a predetermined position;

said releaseable holding means includes a button engageable with a socket of said lever;

mounting means for said button movable away from said lever by said electromagnetic means; and resilient means normally urging said button toward said lever in said second position.

2. In a feed roller release mechanism for a device having a platen mounted on a carriage, a series of pressure rollers normally urged toward said platen for urging paper or the like against said platen, means for moving said pressure rollers away from said platen and means including shaft means for shifting said moving means, the improvement comprising:

a lever movable between first and second positions for moving said shaft means between positions corresponding to the positions of said rollers adjacent and urged toward said platen and said rollers being spaced from said platen;

means urging said lever toward said first position corresponding to the position of said rollers when urged toward said platen;

means for releasably holding said lever in said second position corresponding to said rollers being spaced from said platen;

electromagnetic means for causing said holding means to be released from said lever;

means for activating said electromagnetic means with said lever in said second positions and movement of said carriage to a predetermined position;

said activating means including a switch closed by said lever upon movement to said second position; and said activating means further including said switch closed by movement of said carriage to said predetermined position, in series with said switch closed by said lever and said electromagnetic means.

3. In a feed roller release mechanism, as defined in claim 2, wherein:

said releasable holding means includes a button engageable with a socket of said lever;

mounting means for said button movable away from said lever by said electromagnetic means; and resilient means normally urging said button toward said lever in said second position.

4. In a feed roller release mechanism, as defined in claim 2, wherein:

said device comprises a teletype machine.

5. In a feed roller release mechanism, as defined in claim 2, wherein:

said device comprises a typewriter.

* * * * *